US011425492B2

(12) United States Patent
Lalinde et al.

(10) Patent No.: US 11,425,492 B2
(45) Date of Patent: Aug. 23, 2022

(54) ANGLE MODIFICATION OF AUDIO OUTPUT DEVICES

(71) Applicant: Hewlett-Packard Development Company, L.P., Spring, TX (US)

(72) Inventors: Paul Roberto Lalinde, Spring, TX (US); Chi So, Spring, TX (US); Ben A. Knight, Spring, TX (US); Robert C. Brooks, Spring, TX (US); Stanley Wang, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/048,140

(22) PCT Filed: Jun. 26, 2018

(86) PCT No.: PCT/US2018/039540

§ 371 (c)(1),
(2) Date: Oct. 16, 2020

(87) PCT Pub. No.: WO2020/005212

PCT Pub. Date: Jan. 2, 2020

(65) Prior Publication Data

US 2021/0152929 A1 May 20, 2021

(51) Int. Cl.

| | |
|---|---|
| ***H04R 1/40*** | (2006.01) |
| ***H04R 1/28*** | (2006.01) |
| ***H04R 3/12*** | (2006.01) |
| ***H04R 29/00*** | (2006.01) |

(52) U.S. Cl.
CPC ..... *H04R 1/403* (2013.01); *H04R 1/288* (2013.01); *H04R 3/12* (2013.01); *H04R 29/001* (2013.01); *H04R 2201/025* (2013.01)

(58) Field of Classification Search
CPC ..... H04R 1/345; H04R 1/323; H04R 1/403; H04R 1/288; H04R 3/12; H04R 29/001; H04R 2201/025; H04S 7/301
See application file for complete search history.

(56) References Cited

U.S. PATENT DOCUMENTS

| | | | |
|---|---|---|---|
| 5,594,800 | A | 1/1997 | Gerzon |
| 7,667,728 | B2 | 2/2010 | Kenoyer et al. |
| 8,155,370 | B2 | 4/2012 | Hsu |
| 8,238,547 | B2 | 8/2012 | Ohki et al. |
| 8,971,543 | B1 | 3/2015 | List |
| 9,232,071 | B2 | 1/2016 | Visser et al. |

(Continued)

FOREIGN PATENT DOCUMENTS

| | | |
|---|---|---|
| CN | 102395074 B | 2/2014 |
| CN | 107949823 | 4/2018 |

(Continued)

*Primary Examiner* — Jason R Kurr
(74) *Attorney, Agent, or Firm* — Brooks Cameron & Huebsch PLLC

(57) ABSTRACT

In some examples, a system for angle modification of audio output devices includes a receiver engine to receive an input to modify an angle of the audio output device relative to an axis of a computing device that includes the audio output device, and a modify engine to modify the angle of the audio output device relative to the axis of the computing device based on the input via an electric motor.

13 Claims, 5 Drawing Sheets

(56) References Cited

U.S. PATENT DOCUMENTS

| | | | | |
|---|---|---|---|---|
| 9,264,807 | B2 | 2/2016 | Tashev | |
| 9,554,091 | B1 | 1/2017 | Malegaonkar et al. | |
| 9,584,642 | B2 | 2/2017 | Kadiwala et al. | |
| 9,706,306 | B1 | 7/2017 | List | |
| 9,756,417 | B1 * | 9/2017 | Schnell | H04R 1/323 |
| 9,986,359 | B1 * | 5/2018 | Shi | G06F 3/165 |
| 10,249,276 | B2 * | 4/2019 | Clark | H04R 1/323 |
| 2004/0037445 | A1 | 2/2004 | Kirihara et al. | |
| 2007/0223710 | A1 | 9/2007 | Laurie et al. | |
| 2008/0199037 | A1 * | 8/2008 | Xu | H04R 1/345 381/387 |
| 2008/0304677 | A1 | 12/2008 | Abolfathi et al. | |
| 2013/0039527 | A1 * | 2/2013 | Jensen | H04R 1/24 381/387 |
| 2014/0254811 | A1 * | 9/2014 | Takeda | H04S 7/303 381/58 |
| 2015/0192241 | A1 * | 7/2015 | Shannahan | F16H 7/14 248/178.1 |
| 2016/0150314 | A1 * | 5/2016 | Nishidate | H04S 7/303 381/56 |
| 2017/0156012 | A1 * | 6/2017 | Yu | H04R 29/001 |
| 2017/0295426 | A1 * | 10/2017 | Park | H04R 1/345 |
| 2017/0323356 | A1 | 11/2017 | Gharabegian | |

FOREIGN PATENT DOCUMENTS

| | | | |
|---|---|---|---|
| JP | 2006174277 | A | 6/2006 |
| KR | 20080075351 | A | 8/2008 |
| TW | 201720180 | | 6/2017 |

* cited by examiner

ANGLE MODIFICATION OF AUDIO OUTPUT DEVICES

BACKGROUND

Audio output devices may utilize techniques to convert an audio signal into a corresponding sound. Audio output devices can be included in computing devices. For example, audio output devices included in computing devices may be utilized to play sounds, including instructions, alerts, voice, multimedia including video and/or music, and/or other types of sounds.

DETAILED DESCRIPTION

Audio output devices can output sound in a particular direction. For instance, the sound output of an audio output device may be directed in a manner corresponding to a direction the audio output device is facing.

To achieve sound quality, audio output devices may be oriented in particular ways. For instance, a user may perceive a lower sound quality with audio output devices oriented directly at the user as compared to audio output devices angled slightly away from the user.

Computing devices including audio output devices may be located in different locations. For example, a computing device having audio output devices may be located in a conference room. In another example, the computing device having audio output devices may be located at a workstation such as a desk in an office.

Sound quality may vary based on the location of the computing device having the audio output devices. For example, audio output devices oriented towards a wall or desk may have less sound quality than audio output devices that are not pointed at such an obstruction (e.g., such as in a middle of a conference room).

Angle modification of audio output devices can allow for orientations of audio output devices to be changed. The modification of orientations of audio output devices can compensate for sound quality changes in different computing device locations. For instance, sound quality can be maintained based on whether the computing device is located in a conference room, at a desk, etc.

Figure 1:
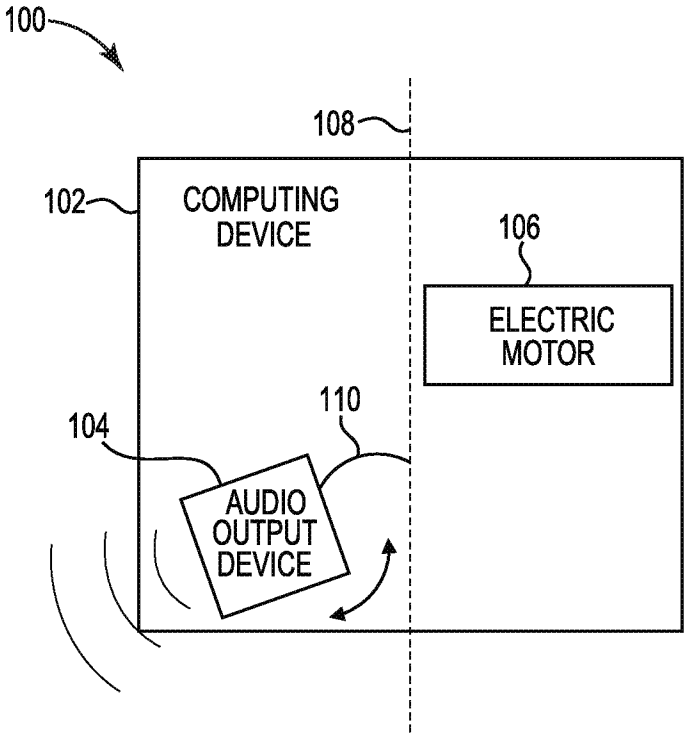
FIG. 1 illustrates an example of a top view of a computing device for angle modification of audio output devices consistent with the disclosure.

FIG. 1 illustrates an example of a top view 100 of a computing device 102 for angle modification of audio output devices consistent with the disclosure. Computing device 102 can include an audio output device 104, electric motor 106, axis 108, and angle 110.

As illustrated in FIG. 1, computing device 102 can include audio output device 104. As used herein, the term "audio output device" refers to a device capable of converting electrical signals to sound and/or pressure waves. As used herein, "a" can refer to one such thing or more than one such thing.

In some examples, audio output device 104 can be a speaker. As used herein, the term "speaker" refers to a device such as an electroacoustic transducer which can convert an electrical signal to an audio output such as sound and/or pressure waves. The audio can be output to a space next to the speaker. For example, a user can listen to an audio output from the speaker, such as instructions, alerts, voice, multimedia including video and/or music, and/or other types of sounds.

Although not illustrated in FIG. 1 for clarity and so as not to obscure examples of the disclosure, the computing device 102 can include a processing resource and a memory resource. The processing resource may be a central processing unit (CPU), a semiconductor based microprocessor, and/or other hardware devices suitable for retrieval and execution of machine-readable instructions stored in a memory resource. The processing resource may fetch, decode, and execute the instructions. As an alternative or in addition to retrieving and executing the instructions, the processing resource may include a plurality of electronic circuits that include electronic components for performing the functionality of the instructions.

The memory resource may be any electronic, magnetic, optical, or other physical storage device that stores executable instructions and/or data. Thus, the memory resource may be, for example, Random Access Memory (RAM), an Electrically-Erasable Programmable Read-Only Memory (EEPROM), a storage drive, an optical disc, and the like. The memory resource may be disposed within the computing device 102. Additionally and/or alternatively, the memory resource may be a portable, external or remote storage medium, for example, that allows the computing device 102 to download the instructions from the portable/external/remote storage medium.

As illustrated in FIG. 1, audio output device 104 is oriented at angle 110 relative to axis 108 of computing device 102. Audio output device 104 can output sound from computing device 102 at the angle 110 relative to axis 108 of computing device 102. For instance, music being output by audio output device 104 is output at angle 110 relative to axis 108.

Angle 110 can be a 30 degree (°) angle relative to axis 108. However, examples of the disclosure are not so limited. For example, angle 110 can be modified to be greater than 30° or less than 30°, as is further described herein.

Computing device 102 can determine an amount of rotation in order to modify angle 110 of audio output device 104 relative to axis 108 based on an input received by computing device 102. In some examples, the input can be audio feedback received by a microphone included in computing device 102, as is further described in connection with FIG. 2A, In some examples, the input can be a user input, as is further described in connection with FIG. 2A.

Computing device 102 can modify angle 110 of audio output device 104 relative to axis 108 of computing device 102 based on the input via electric motor 106. As used herein, the term "electric motor" refers to an electrical device that converts electrical energy into mechanical energy. Electric motor 106 can modify the angle 110 of audio output device 104 by causing rotation of audio output device 104. For example, audio output device 104 can be connected to an adjustable frame, as is further described in connection with FIG. 2A. The adjustable frame can be connected to electric motor 106 such that electric motor 106 can modify an angle of the adjustable frame to cause the angle 110 of audio output device 104 to be modified.

In some examples, electric motor 106 can modify the angle 110 of audio output device 104 relative to axis 108 to be greater than 30°. For example, electric motor 106 can modify angle 110 to be 35° by rotating audio output device 104 in a counter-clockwise rotation in the orientation illustrated in FIG. 1.

Although electric motor 106 is described above as modifying angle 110 from 30° to 35°, examples of the disclosure are not so limited. For example, electric motor 106 can modify angle 110 to be an angle greater than 30° but less than a maximum angle of counter-clockwise rotation (e.g., as oriented in FIG. 1). The maximum angle of rotation can be based on an amount of audio output devices 104 included in computing device 102. For example, computing device 102 can include a plurality of audio output devices. The maximum angle of rotation can be based on an amount of the plurality of audio output devices, as is further described in connection with FIG. 2A.

In some examples, electric motor 106 can modify the angle 110 of audio output device 104 relative to axis 108 to be less than 30°. For example, electric motor 106 can modify angle 110 to be 28° by rotating audio output device 104 in a clockwise rotation in the orientation illustrated in FIG. 1.

Although electric motor 106 is described above as modifying angle 110 from 30° to 28°, examples of the disclosure are not so limited. For example, electric motor 106 can modify angle 110 to be an angle less than 30° but greater than a minimum angle of clockwise rotation (e.g., as oriented in FIG. 1). The minimum angle of rotation can be based on an amount of audio output devices 104 included in computing device 102. For example, computing device 102 can include a plurality of audio output devices. The minimum angle of rotation can be based on an amount of the plurality of audio output devices, as is further described in connection with FIG. 2A.

Figure 2B:
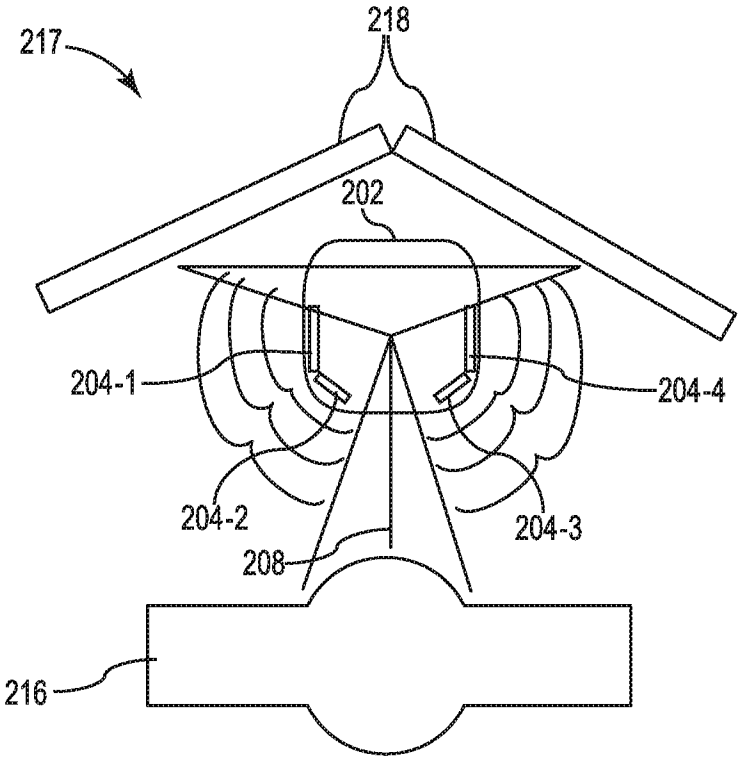
FIG. 2B illustrates an example of a top view of a user and a computing device located near a wall consistent with the disclosure.
Figure 2A:
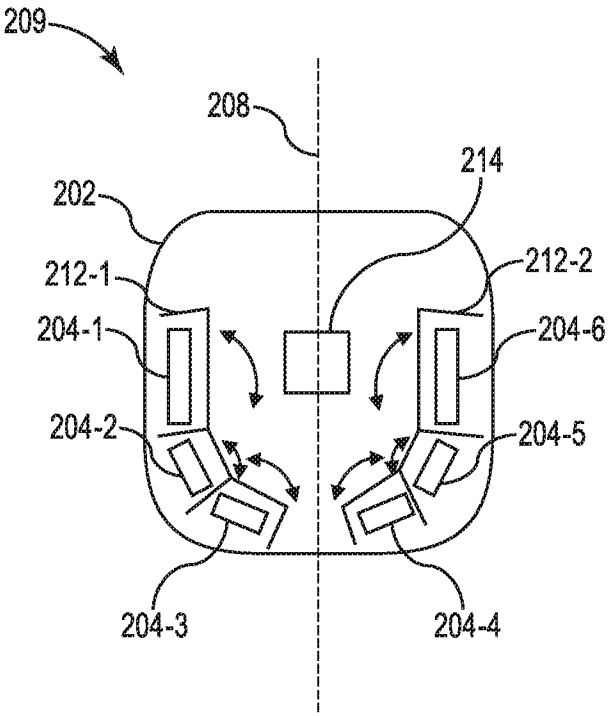
FIG. 2A illustrates an example of a top view of a computing device for angle modification of audio output devices consistent with the disclosure.

FIG. 2A illustrates an example of a top view 209 of a computing device 202 for angle modification of audio output devices 204 consistent with the disclosure. Computing device 202 can include a plurality of audio output devices 204-1, 204-2, 204-3, 204-4, 204-5, 204-6 (referred to collectively as plurality of output devices 204), axis 208, adjustable frame 212-1, 212-2, and microphone 214.

Computing device 202 can receive an input to modify an angle of an audio output device 204 of a plurality of audio output devices 204 relative to an axis 208 of computing device 202. As illustrated in FIG. 2A, computing device 202 can include six audio output devices 204. Each audio output device 204 can be in an orientation having an angle relative to axis 208. For example, audio output device 204-1 can be at a 90° angle relative to axis 208 (measured right to left from axis 208 to audio output device 204-1 in the orientation illustrated in FIG. 2A), audio output device 204-2 can be at a 45° angle relative to axis 208, and audio output device 204-3 can be at a 30° angle relative to axis 208. Similarly, audio output device 204-4 can be at a 30° angle relative to axis 208 (measured left to right from axis 208 to audio output device 204-4 in the orientation illustrated in FIG. 2A), audio output device 204-2 can be at a 45° angle relative to axis 208, and audio output device 204-3 can be at a 90° angle relative to axis 208.

Although audio output devices 204 are described above and illustrated in FIG. 2A as having particular angles (e.g., 30°, 45°, and 90°), examples of the disclosure are not so limited. For example, audio output devices 204 can be oriented at different angles.

Each of the audio output devices 204 can be connected to an adjustable frame 212. As used herein, the term "frame" refers to a structure that supports other components. For example, adjustable frame 212-1 can be a structure that supports audio output devices 204-1, 204-2, 204-3. Similarly, adjustable frame 212-2 can be a structure that supports audio output devices 204-4, 204-5, 204-6.

In some examples, the portions of adjustable frame 212-1 that support audio output devices 204-1, 204-2, 204-3 can be rotated independently. For example, the portion of adjustable frame 212-1 that supports audio output device 204-1 can be rotated independently of the portions of adjustable frame 212-1 that support audio output devices 204-2 and 204-3, the portion of adjustable frame 212-1 that supports audio output device 204-2 can be rotated independently of the portions of adjustable frame 212-1 that support audio output devices 204-1 and 204-3, and the portion of adjustable frame 212-1 that supports audio output device 204-1 can be rotated independently of the portions of adjustable frame 212-1 that support audio output devices 204-1 and 204-2, as is further described herein. Similarly, the portion of adjustable frame 212-2 that supports audio output device 204-4 can be rotated independently of the portions of adjustable frame 212-2 that support audio output devices 204-5 and 204-6, the portion of adjustable frame 212-2 that supports audio output device 204-5 can be rotated independently of the portions of adjustable frame 212-2 that support audio output devices 204-4 and 204-6, and the portion of adjustable frame 212-2 that supports audio output device 204-6 can be rotated independently of the portions of adjustable frame 212-2 that support audio output devices 204-4 and 204-5, as is further described herein. Computing device 202 can rotate adjustable frames 212-1 and/or 212-2 via an electric motor, as previously described in connection with FIG. 1.

In some examples, the portions of adjustable frame 212-1 that support audio output devices 204-1, 204-2, 204-3 can be linked such that rotation of one portion of adjustable frame 212-1 can cause rotation of the remaining portions of adjustable frame 212-1. Similarly, the portions of adjustable frames 212-2 can be linked such that rotation of one portion of adjustable frame 212-2 can cause rotation of the remaining portions of adjustable frame 212-2. For example, rotation of the portion of adjustable frame 212-1 that supports audio output device 204-1 can cause rotation of the portions of adjustable frame 212-1 that support audio output devices 204-2 and 204-3, rotation of the portion of adjustable frame 212-1 that supports audio output device 204-2 can cause rotation of the portions of adjustable frame 212-1 that support audio output devices 204-1 and 204-3, and rotation of the portion of adjustable frame 212-1 that supports audio output device 204-3 can cause rotation of the portions of adjustable frame 212-1 that support audio output devices 204-1 and 204-2. Similarly, rotation of the portion of adjustable frame 212-2 that supports audio output device 204-4 can cause rotation of the portions of adjustable frame 212-2 that support audio output devices 204-5 and 204-6, rotation of the portion of adjustable frame 212-2 that supports audio output device 204-5 can cause rotation of the portions of adjustable frame 212-2 that support audio output devices 204-4 and 204-6, and rotation of the portion of adjustable frame 212-2 that supports audio output device 204-6 can cause rotation of the portions of adjustable frame 212-2 that support audio output devices 204-4 and 204-5. Computing device 202 can rotate adjustable frames 212-1 and/or 212-2 via an electric motor, as previously described in connection with FIG. 1.

As described above, computing device 202 can receive an input to modify an angle of an audio output device 204. In some examples, the input can be received by microphone 214, and in some examples, the input can be a user input, as are further described herein.

In some examples, computing device 202 can receive an input via microphone 214. As used herein, the term "microphone" refers to a device having a transducer that converts sound into an electrical signal. For example, microphone 214 can receive audio feedback and convert the audio feedback into an electrical signal. As used herein, the term "audio feedback" refers to an audio output by audio output devices 204 that is received as an input to microphone 214. For example, audio output devices 204 can output a sound such as a voice. The sound (e.g., the voice) can be a pressure wave that can bounce off of an object such as a wall and be directed back towards and be received by microphone 214. Audio feedback can result in poor sound quality from audio output devices 204 and as a result, modifying an angle of the audio output devices 204 may be desirable to reduce or eliminate audio feedback.

Computing device 202 can determine, based on the input, an amount of rotation of audio output devices 204. For example, the audio feedback received by microphone 214 may be above a predetermined threshold amount of audio feedback. As a result, computing device 202 can determine the angle of audio output device 204 has to be modified in response to the audio feedback exceeding the threshold amount.

Computing device 202 can determine an amount of rotation to reduce the audio feedback to be at or lower than the threshold amount of audio feedback. For example, computing device 202 can determine an amount of rotation to be 5° counter-clockwise (e.g., as oriented in FIG. 2A) to reduce the audio feedback to be at or lower than the threshold amount of audio feedback.

Computing device 202 can modify the angle of audio output device 204 relative to axis 208 by the amount of rotation. For example, as described above, computing device 202 can determine the amount of rotation to be 5°, and modify the angle of audio output device 204 relative to axis 208 by 5° by rotating audio output device 204 5° counter-clockwise. In the orientation illustrated in FIG. 2A, the rotation can be described by a "yaw" motion. As used herein, the term "yaw" refers to a clockwise or counter-clockwise motion corresponding to the orientation of computing device 202/audio output devices 204 as illustrated in FIG. 2A.

Although the rotation of audio output device 204 is described above as being rotated 5° counter-clockwise, examples of the disclosure are not so limited. For example, the rotation of audio output device 204 can 5° in a clockwise direction.

As previously described above, audio output devices 204 can be connected to adjustable frames 212. To facilitate rotation of audio output devices 204, computing device 202 can modify an angle of adjustable frame 212. For example, since audio output devices 204 are connected to adjustable frame 212, computing device 202 can rotate adjustable frame 212 to rotate audio output devices 204.

As described above, in some examples the angle of each audio output device 204 can be modified independently. For example, computing device 202 can modify the angle of audio output device 204-1 by modifying the angle of the portion of adjustable frame 212-1 that supports audio output device 204-1, modify the angle of audio output device 204-2 by modifying the angle of the portion of adjustable frame 212-1 that supports audio output device 204-2, modify the angle of audio output device 204-3 by modifying the angle of the portion of adjustable frame 212-1 that supports audio output device 204-3, modify the angle of audio output device 204-4 by modifying the angle of the portion of adjustable frame 212-2 that supports audio output device 204-4, modify the angle of audio output device 204-5 by modifying the angle of the portion of adjustable frame 212-2 that supports audio output device 204-5, and modify the angle of audio output device 204-6 by modifying the angle of the portion of adjustable frame 212-2 that supports audio output device 204-6, In other words, computing device 202 can modify an angle of a particular audio output device 204 without modifying the angles of the remaining audio output devices 204.

As described above, in some examples the portions of adjustable frames 212-1 can be linked such that rotation of one portion of adjustable frame 212-1 can cause rotation of the remaining portions of adjustable frame 212-1. Similarly, the portions of adjustable frames 212-2 can be linked such that rotation of one portion of adjustable frame 212-2 can cause rotation of the remaining portions of adjustable frame 212-2. In other words, modifying an angle of one audio output device 204 (e.g., audio output device 204-1) can cause the angles of a sub-group of a remaining amount of audio output devices (e.g., audio output devices 204-2, 204-3) to be modified. For example, computing device 202 can modify the angle of audio output device 204-1 by modifying the angle of the portion of adjustable frame 212-1 supporting audio output device 204-1, and as a result, the angles of audio output devices 204-2, 204-3 can be correspondingly modified as a result of the portions of adjustable frame 212-1 supporting audio output devices 204-2 and 204-3 also being modified. Computing device 202 can adjust the angle of the portion of adjustable frame 212-1 support audio output device 204-2 or 204-3 with similar results.

Similarly, computing device 202 can modify the angle of audio output device 204-4 by modifying the angle of the portion of adjustable frame 212-2 supporting audio output device 204-4, and as a result, the angles of audio output devices 204-5, 204-6 can be correspondingly modified as a result of the portions of adjustable frame 212-2 supporting audio output devices 204-5 and 204-6 also being modified. Computing device 202 can adjust the angle of the portion of adjustable frame 212-2 support audio output device 204-5 or 204-6 with similar results. In other words, when the portions of adjustable frame 212 are linked, modifying the angle of one portion of adjustable frame 212 can result in the angles of other portions of adjustable frame 212 being modified.

In some examples, computing device 202 can generate an instruction to a user to modify angle of audio output device 204 relative to axis 208 of computing device 202 by the determined amount of rotation. The instruction can include an audible instruction, a displayed instruction (e.g., via a display, such as a display of computing device 202, a display of a mobile device of the user where the instruction is transmitted to the mobile device of the user, etc.), among other types of instruction. For instance, an audible instruction can include a generated audible message emitted by audio output device 204 to instruct the user to rotate audio output device 204 by 5°. In another instance, the instruction can be displayed on a display of computing device 202 to instruct the user to rotate audio output device 204 by 5°.

In some examples, computing device 202 can receive an input to modify an angle of an audio output device 204 relative to axis 208 of computing device 202 as a user input. The user input can include an amount of rotation of audio output devices 204.

Although not illustrated in FIG. 2A for clarity and so as not to obscure examples of the disclosure, computing device 202 can include peripheral devices. For example, peripheral devices can include a keyboard, mouse, microphone 214, display (e.g., a touchscreen display), and/or other peripheral devices to receive a user input. Computing device 202 can receive the user input via a keyboard, mouse, microphone 214, touchscreen display, etc.

In some examples, the user input can include an amount of rotation of a particular audio output device 204 (e.g., audio output device 204-1 rotated by 5°). In some examples, the user input can include an amount of rotation of a plurality of audio output devices (e.g., audio output devices 204-1, 204-2, and 204-3 rotated by) 5°. In some examples, the user input can include an amount of rotation of particular ones of the plurality of audio output devices (e.g., audio output devices 204-1 and 204-2 rotated by 5°, audio output device 204-3 rotated by 3°).

In some examples, the user input can be based on the generated instruction to the user to modify the angle of audio output device 204, For example, as described above, the generated instruction can be for the user to modify the angle of audio output device 204 relative to axis 208 of computing device 202 by 5°. In some examples, the user can, via a user input based on the generated instruction, input a command to the computing device 202 to cause computing device 202 to modify the angle of audio output device 204 by 5°. In some examples, the user can physically modify the angle of audio output device 204 by 5° by rotating the audio output device 204 with their hand.

Computing device 202 can modify the angle of audio output device 204 relative to axis 208 by the amount of rotation included in the user input. In an example in which portions of adjustable frames 212 are not linked and angles of audio output devices 204 can be modified independently, the user input can include an amount of rotation (e.g., 5°) and an angle to modify of a particular audio output device (e.g., audio output device 204-5). As a result, computing device 202 can modify the angle of audio output device 204-5 by 5° by modifying the angle of the portion of adjustable frame 212-2 that supports audio output device 204-5. In an example in which portions of adjustable frames 212 are linked, the user input can include an amount of rotation (e.g., 5°) and an adjustable frame 212 (e.g., adjustable frame 212-2). As a result, computing device 202 can modify the angle of audio output devices 204-4, 204-5, 204-6 by 5° by modifying the angle of a portion of adjustable frame 212-2. Computing device 202 can rotate adjustable frames 212-1 and/or 212-2 via an electric motor, as previously described in connection with FIG. 1.

Although not illustrated in FIG. 2A for clarity and so as not to obscure examples of the disclosure, audio output devices 204 can include flexible sound-proof material. As used herein, the term "sound-proof material" refers to a material which absorbs and/or deflects sound. For example, the flexible sound-proof material can prevent sound from escaping between audio output devices 204. The flexible sound-proof material can include an accordion shape such that it can be stretched or compressed as a result of audio output devices 204 being rotated.

The flexible sound-proof material can span between audio output devices 204. For example, flexible sound-proof material can span between audio output devices 204-1, 204-2, 204-3 such that, when audio output devices 204-1, 204-2, 204-3 are rotated to modify the angles of audio output devices 204-1, 204-2, 204-3 relative to axis 208, sound does not escape between audio output devices 204-1, 204-2, 204-3. Similarly, the flexible sound-proof material can span between audio output devices 204-4, 204-5, 204-6.

Although computing device 202 is illustrated in FIG. 2A as having six audio output devices, examples of the disclosure are not so limited. For example, computing device 202 can include less than six audio output devices (e.g., four audio output devices, where each side of computing device 202 includes two audio output devices) or more than six audio output devices (e.g., eight audio output devices, where each side of computing device 202 includes four audio output devices). Additionally, as previously described in connection with FIG. 1, a maximum angle of rotation of audio output devices 204 can be based on an amount of audio output devices included in computing device 202. For example, as illustrated in FIG. 2A, computing device 202 includes six audio output devices 204 and as a result, a maximum rotation angle may be 5-15°. In some examples, computing device 202 can include four speakers and as a result, the maximum rotation angle may be 20°-30°.

FIG. 2B illustrates an example of a top view 217 of a user 216 and a computing device 202 located near a wall 218 consistent with the disclosure. Computing device 202 can include a plurality of audio output devices 204-1, 204-2, 204-3, 204-4 and an axis 208.

As illustrated in FIG. 2B, a user 216 may be oriented near computing device 202. Additionally, computing device 202 can be located near wall 218. For example, user 216 may be utilizing computing device 202 at a desk in a cubicle.

In an example in which the orientation of audio output devices 204 were facing the wall 218, sound emitted by audio output devices 204 can bounce off wall 218. As a result, sound quality from audio output devices 204 may be perceived by user 216 as being poor, Additionally, computing device 202 may include a microphone which, in some instances, can receive the emitted sound which has bounced off wall 218 which can produce audio feedback. In an instance in which user 216 is conducting a voice call, audio feedback can result in poor call quality.

In the example described above, an angle of audio output devices 204 can be modified such that audio output devices 204 are oriented as illustrated in FIG. 2B. For example, as oriented as illustrated in FIG. 2B, audio output devices 204 can substantially avoid sound emitted by audio output devices 204 bouncing off of wall 218.

Angle modification of audio output devices can allow improved sound quality in different computing device locations. The sound quality can be maintained based on whether the computing device is located in an open conference room, at a desk in a confined space, etc.

Figure 3:
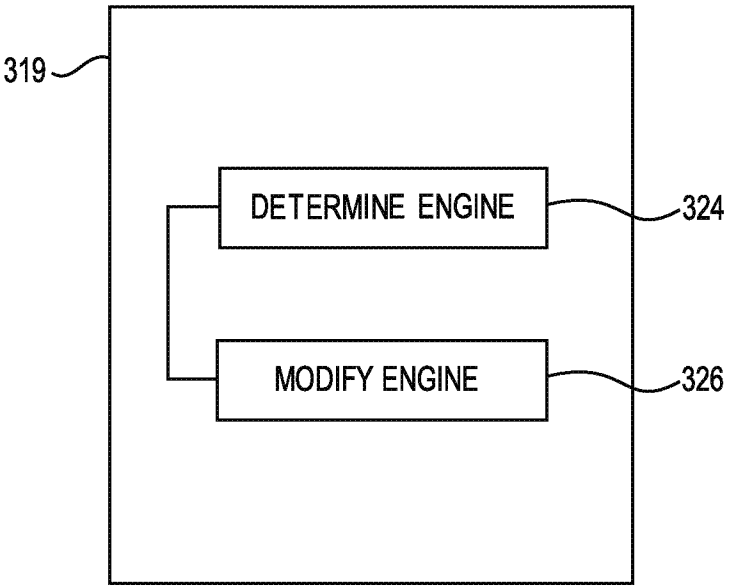
FIG. 3 illustrates an example of a system for angle modification of audio output devices consistent with the disclosure.

FIG. 3 illustrates an example of a system 319 for angle modification of audio output devices consistent with the disclosure. The system 319 can include a plurality of engines (determine engine 324, modify engine 326). Angle modification of audio output devices system 319 can include additional or fewer engines that are illustrated to perform the various elements as described in connection with FIGS. 1, 2A, and 2B.

The plurality of engines (e.g., determine engine 324, modify engine 326) can include a combination of hardware and machine-readable instructions (e.g., stored in a memory resource such as a non-transitory machine-readable medium) that are executable using hardware components such as a processor, but at least hardware, to perform elements described herein (e.g., receive an input to modify an angle of the audio output device relative to an axis of the computing device, and modify the angle of the audio output device relative to the axis of the computing device based on the input via an electric motor, etc.)

The determine engine 324 can include hardware and/or a combination of hardware and machine-readable instructions, but at least hardware, to determine an amount of rotation in order to modify an angle of the audio output device relative to an axis of the computing device based on an input. The input can be received via a microphone or via a user input.

Figure 4:
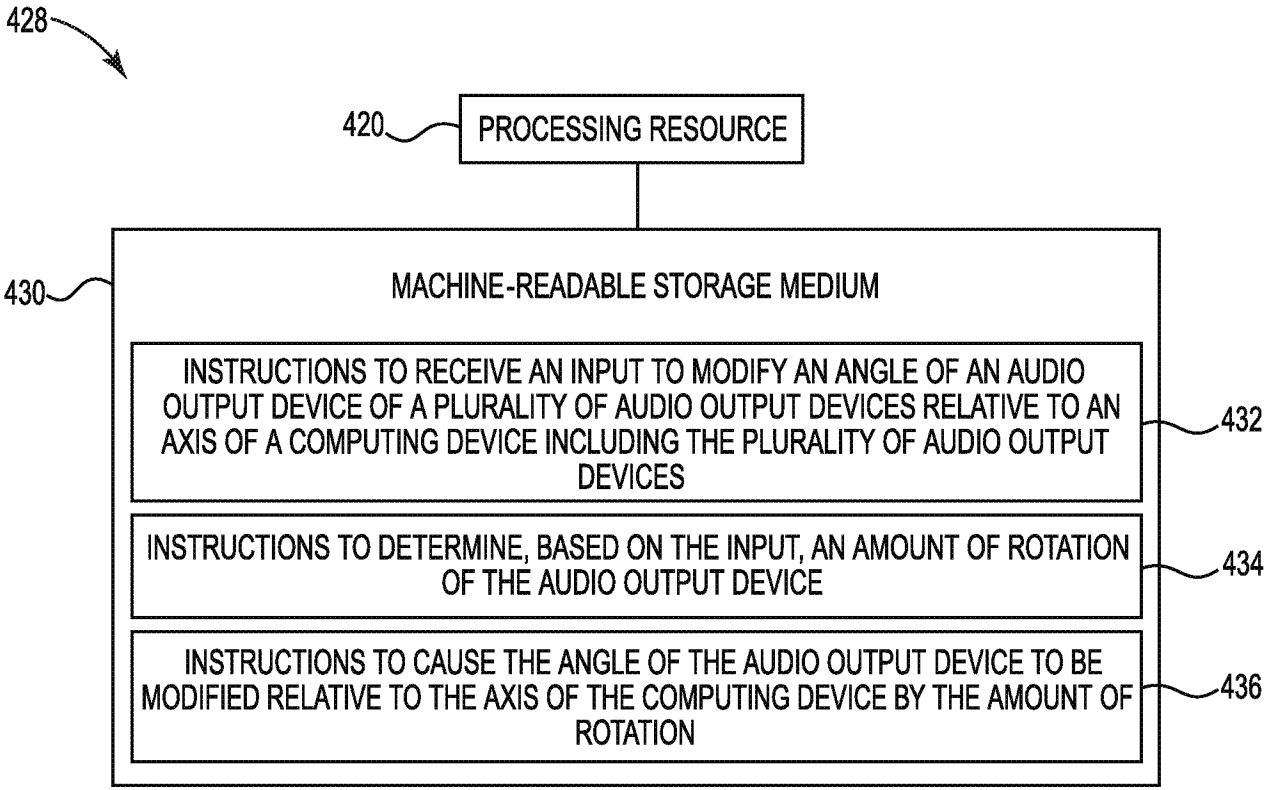
FIG. 4 illustrates a block diagram of an example of a system suitable for angle modification of audio output devices consistent with the disclosure.

The modify engine can include hardware and/or a combination of hardware and machine-readable instructions, but at least hardware, to modify the angle of the audio output device relative to the axis of the computing device based on the input via an electric motor. The electric motor can modify the angle of the audio output device by causing rotation of audio output device, FIG. 4 illustrates a block diagram of an example of a system 428 suitable for angle modification of audio output devices consistent with the disclosure. In the example of FIG. 4, system 428 includes a processing resource 420 and a machine-readable storage medium 430. Although the following descriptions refer to an individual processing resource and an individual machine-readable storage medium, the descriptions may also apply to a system with multiple processing resources and multiple machine-readable storage mediums. In such examples, the instructions may be distributed across multiple machine-readable storage mediums and the instructions may be distributed across multiple processing resources. Put another way, the instructions may be stored across multiple machine-readable storage mediums and executed across multiple processing resources, such as in a distributed computing environment.

Processing resource 420 may be a central processing unit (CPU), microprocessor, and/or other hardware device suitable for retrieval and execution of instructions stored in machine-readable storage medium 430. In the particular example shown in FIG. 4, processing resource 420 may receive, determine, and send instructions 432, 434, 436. As an alternative or in addition to retrieving and executing instructions, processing resource 420 may include an electronic circuit comprising an electronic component for performing the operations of the instructions in machine-readable storage medium 430. With respect to the executable instruction representations or boxes described and shown herein, it should be understood that part or all of the executable instructions and/or electronic circuits included within one box may be included in a different box shown in the figures or in a different box not shown.

Machine-readable storage medium 430 may be any electronic, magnetic, optical, or other physical storage device that stores executable instructions. Thus, machine-readable storage medium 430 may be, for example, Random Access Memory (RAM), an Electrically-Erasable Programmable Read-Only Memory (EEPROM), a storage drive, an optical disc, and the like. The executable instructions may be "installed" on the system 428 illustrated in FIG. 4. Machine-readable storage medium 430 may be a portable, external or remote storage medium, for example, that allows the system 428 to download the instructions from the portable/external/remote storage medium. In this situation, the executable instructions may be part of an "installation package". As described herein, machine-readable storage medium 430 may be encoded with executable instructions related to angle modification of audio output devices. That is, using processing resource 420, machine-readable storage medium 430 may instruct a computing device to modify an angle of an audio output device, among other operations.

Instructions 432, when executed by processing resource 420, may cause system 428 to receive an input to modify an angle of an audio output device of a plurality of audio output devices relative to an axis of a computing device including the plurality of audio output devices. In some examples, the input can be received by a microphone. For example, the input can be audio feedback received by the microphone. In some examples, the input can be a user input received via a peripheral device connected to the computing device.

Instructions 434, when executed by processing resource 420, may cause system 428 to determine, based on the input, an amount of rotation of the audio output device. For example, the audio feedback received by the microphone can exceed a threshold amount of audio feedback, and the computing device can determine an amount of rotation to reduce the audio feedback to be at or below the threshold amount of audio feedback. In some examples, the computing device can determine the amount of rotation as included in the user input received by the computing device.

Instructions 436, when executed by processing resource 420, may cause system 428 to cause the angle of the audio output device to be modified relative to the axis of the computing device by the amount of rotation. For example, the computing device can cause the audio output device to be rotated in order to modify the angle of the audio output device relative to the axis of the computing device. The audio output device can be connected to an adjustable frame. The computing device can modify the angle of the adjustable frame relative to the axis of the computing device in order to cause the angle of the audio output device relative to the axis of the computing device to also be modified. The computing device can cause the angle of the audio output device to be modified via an electric motor.

Figure 5:
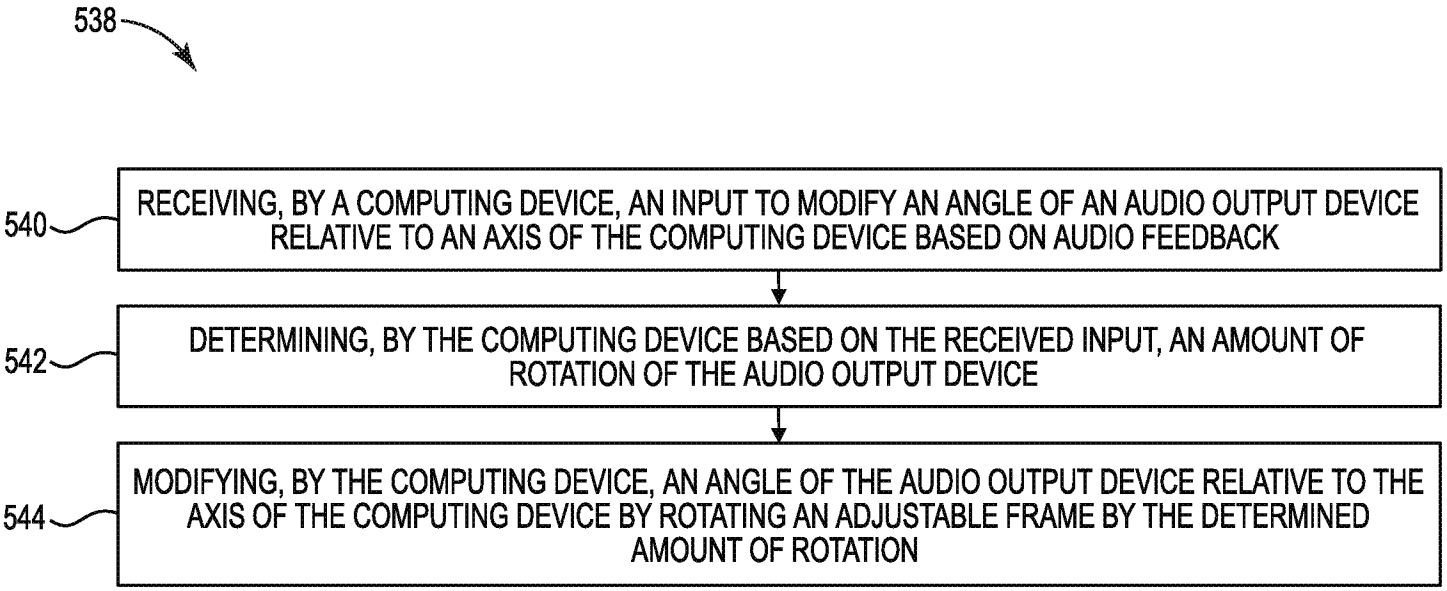
FIG. 5 illustrates an example of a method for angle modification of audio output devices consistent with the disclosure.

FIG. 5 illustrates an example of a method 538 for angle modification of audio output devices consistent with the disclosure. For example, method 538 can be performed by a computing device (e.g., computing device 102, 202, previously described in connection with FIGS. 1 and 2, respectively) to provide angle modification of audio output devices.

At 540, the method 538 includes receiving, by a computing device, an input to modify an angle of an audio output device relative to an axis of the computing device based on audio feedback. The input can be received by a microphone of the computing device.

Although the input to modify the angle of the audio output device is described above as being received by a microphone, examples of the disclosure are not so limited. For example, the computing device can receive the input to modify the angle of the audio output device via a user input to the computing device.

At 542, the method 538 includes determining, by the computing device based on the received input, an amount of rotation of the audio output device. The computing device can determine the amount of rotation based on the amount of audio feedback received by the microphone exceeding a threshold feedback amount. For example, the computing device can determine an amount of rotation of the audio output device to reduce the audio feedback to at or below the threshold feedback amount.

At 544, the method 538 includes modifying, by the computing device, an angle of the audio output device relative to the axis of the computing device by rotating an adjustable frame by the determined amount of rotation. For example, the audio output device can be connected to the adjustable frame. The computing device can modify the angle of the adjustable frame relative to the axis of the computing device and as a result, modify the angle of the audio output device relative to the axis of the computing device, as the angles of the adjustable frame and audio output device relative to the axis of the computing device can be the same. The computing device can modify the angle of the adjustable frame and audio output device via an electric motor.

The above specification, examples and data provide a description of the method and applications, and use of the system and method of the disclosure, Since many examples can be made without departing from the spirit and scope of the system and method of the disclosure, this specification merely sets forth some of the many possible example configurations and implementations.

What is claimed is:

1. A computing device, comprising:

a microphone;

an adjustable frame including a linked together first portion and second portion;

a first audio output device supported by the first portion of the adjustable frame and a second audio output device supported by the second portion of the adjustable frame;

a processing resource; and a non-transitory machine-readable storage medium storing instructions executable by the processing resource to:

receive an input as audio feedback via the microphone;

determine an amount of rotation in order to modify an angle of the first audio output device relative to an axis of the computing device; and modify the angle of the first audio output device relative to the axis of the computing device based on the input by rotating the first portion of the adjustable frame via an electric motor, wherein:

rotating the first portion of the adjustable frame causes rotation of the second portion of the adjustable frame; and rotation of the second portion modifies an angle of the second audio output device relative to the axis.

2. The computing device of claim 1, including instructions to cause the processing resource to modify the angle of the first audio output device in response to the audio feedback exceeding a threshold feedback amount.

3. The computing device of claim 1, wherein the processing resource is to generate an instruction to a user to modify, by the determined amount of rotation, the angle of the first audio output device relative to the axis of the computing device.

4. The computing device of claim 1, wherein:

the computing device includes a plurality of audio output devices including the first audio output device and the second audio output device; and each of the plurality of audio output devices include flexible sound-proof material.

5. The computing device of claim 1, including instructions to cause the processing resource to modify the angle of the first audio output device by causing the first audio output device to move in a yaw motion.

6. The computing device of claim 1, including instructions to cause the processing resource to cause the first audio output device to emit sound.

7. The computing device of claim 6, wherein the emitted sound is received as the input via the microphone.

8. A non-transitory machine-readable storage medium having stored thereon machine-readable instructions to cause a processing resource to:

receive an input via a microphone of a computing device to modify an angle of a first audio output device of a plurality of audio output devices included in the computing device relative to an axis of the computing device, wherein:

the first audio output device is supported by a first portion of an adjustable frame; and a second audio output device of the plurality of audio output devices is supported by a second portion of the adjustable frame that is linked together with the first portion of the adjustable frame;

determine, based on the input, an amount of rotation of the first audio output device; and cause the angle of the first audio output device to be modified relative to the axis of the computing device by rotating the first portion of the adjustable frame by the amount of rotation wherein:

rotating the first portion of the adjustable frame causes rotation of the second portion of the adjustable frame; and rotation of the second portion modifies an angle of the second audio output device relative to the axis.

9. The medium of claim 8, wherein the instructions to modify the angle of the audio output device cause the angles of a sub-group of a remaining amount of plurality of audio output devices to be modified.

10. The medium of claim 8, wherein the input is audio feedback from the plurality of audio output devices that is received by the microphone included in the computing device.

11. The medium of claim 10, comprising instructions to:

determine the amount of rotation of the first audio output device based on the audio feedback to reduce the audio feedback to a threshold feedback amount; and modify the angle of the first audio output device based on the determined amount of rotation.

12. A method, comprising:

receiving, by a microphone of a computing device, an input to modify an angle of a first audio output device included in the computing device relative to an axis of the computing device based on audio feedback, wherein:

the first audio output device is supported by a first portion of an adjustable frame; and a second audio output device is supported by a second portion of the adjustable frame that is linked together with the first portion of the adjustable frame;

determining, by the computing device based on the received input, an amount of rotation of the first audio output device; and modifying, by the computing device, an angle of the first audio output device relative to the axis of the computing device by rotating the first portion of the adjustable frame by the determined amount of rotation, wherein:

rotating the first portion of the adjustable frame causes rotation of the second portion of the adjustable frame; and rotation of the second portion modifies an angle of the second audio output device relative to the axis.

13. The method of claim 12, wherein the method includes determining the amount of rotation of the first audio output device based on an amount of audio feedback received by the microphone exceeding a threshold feedback amount.

* * * * *